US009698496B2

(12) United States Patent
Yudate

(10) Patent No.: US 9,698,496 B2
(45) Date of Patent: Jul. 4, 2017

(54) CRIMP TERMINAL

(71) Applicant: YAZAKI CORPORATION, Tokyo (JP)

(72) Inventor: Takahiro Yudate, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/138,333

(22) Filed: Apr. 26, 2016

(65) Prior Publication Data

US 2016/0240936 A1 Aug. 18, 2016

Related U.S. Application Data

(63) Continuation of application No. PCT/JP2014/080710, filed on Nov. 20, 2014.

(30) Foreign Application Priority Data

Nov. 25, 2013 (JP) ..... 2013-242575

(51) Int. Cl.
*H01R 4/18* (2006.01)
*H01R 4/26* (2006.01)
*H01R 13/04* (2006.01)

(52) U.S. Cl.
CPC ..... *H01R 4/188* (2013.01); *H01R 4/185* (2013.01); *H01R 4/26* (2013.01); *H01R 13/04* (2013.01)

(58) Field of Classification Search
CPC ..... H01R 4/188; H01R 4/185
USPC ..... 439/877–882
See application file for complete search history.

(56) References Cited

U.S. PATENT DOCUMENTS 5,658,163 A * 8/1997 DeRoss ..... H01R 4/2495 174/84 C
8,628,363 B2 * 1/2014 Kobayashi ..... H01R 4/185 439/877
2010/0087105 A1 * 4/2010 Gump ..... H01R 4/188 439/879
2011/0177728 A1 7/2011 Uchiyama et al.
2013/0130569 A1 * 5/2013 Sato ..... H01R 4/206 439/882
2013/0137315 A1 * 5/2013 Onuma ..... B21J 5/12 439/877

(Continued)

FOREIGN PATENT DOCUMENTS

JP S51-143186 U 11/1976
JP 2009-123623 A 6/2009
JP 2010-129448 A 6/2010

*Primary Examiner* — Gary Paumen
(74) *Attorney, Agent, or Firm* — MOTS Law, PLLC

(57) ABSTRACT

A crimp terminal includes a core-wire crimping part that crimps a core wire including strands of an electrical wire so as to surround the core wire from the outside. The core-wire crimping part is provided, on its surface for arranging the core wire thereon, with serrations extending in a direction perpendicular to the axial direction of the core wire. The serrations include central serration parts and end serration parts which are arranged on respective surfaces that face each other when the core-wire crimping part is crimped to the core wire and which have protruding cross-sectional shapes. The central serration parts and the end serration parts are arranged at respective positions deviated from each other in the axial direction of the core wire.

7 Claims, 7 Drawing Sheets

(56) References Cited

U.S. PATENT DOCUMENTS

| | | | | |
|---|---|---|---|---|
| 2013/0143454 | A1* | 6/2013 | Onuma | H01R 4/188<br>439/877 |
| 2014/0004759 | A1* | 1/2014 | Kondou | H01R 4/185<br>439/878 |
| 2014/0038475 | A1* | 2/2014 | Harasawa | H01R 4/10<br>439/877 |
| 2014/0213123 | A1* | 7/2014 | Ito | H01R 4/188<br>439/877 |
| 2014/0273666 | A1* | 9/2014 | Corman | H01R 4/185<br>439/877 |

* cited by examiner

CRIMP TERMINAL

CROSS REFERENCE TO RELATED APPLICATIONS

This application is a continuation of International Application No. PCT/JP2014/080710, filed Nov. 20, 2014, and based upon and claims the benefit of priority from Japanese Patent Application No. 2013-242575, filed Nov. 25, 2013, the entire contents of ALL OF WHICH ARE INCORPORATED HEREIN BY REFERENCE.

TECHNICAL FIELD

The present application relates to a crimp terminal for connecting with an electric wire.

BACKGROUND ART

As a conventional crimp terminal of this kind, there is a terminal disclosed in JP 2009-123623 A (PTL 1). As illustrated in FIGS. 6 and 7, an electrical wire W connected to a conventional crimp terminal 110 includes a core wire 101 composed of a plurality of strands 101*a* and an insulating jacket 102 covering the outer periphery of the core wire 101. On a leading-end side of the electric wire W, the insulating jacket 102 is removed so as to expose the core wire 101.

The crimp terminal 110 includes a partner-terminal connecting part 111 and a wire connecting part 115. The wire connecting part 115 includes a core-wire crimping part 116 and a jacket crimping part 117. The core-wire crimping part 116 includes a first bottom part 116*a* and a pair of first crimping-piece parts 116*b* extending front both sides of the first bottom part 116*a*. The core-wire crimping part 116 is formed, on respective inner surfaces of the first bottom part 116*a* and the pair of first crimping-piece parts 116*b*, with three long grooves (serrations) 118. The long grooves 118 are arranged so as to each have a longitudinal direction which is perpendicular to the axial direction of the core wire 101. The jacket crimping part 117 includes a second bottom part 117*a* and a pair of second crimping-piece parts 117*b* extending from bath sides of the second bottom part 117*a*.

In the crimp terminal 110, the exposed core wire 101 is crimped by the core-wire crimping part 116, while the insulating jacket 102 is crimped by the jacket crimping part 117.

SUMMARY

In the conventional crimp terminal 110, however, the long grooves 118 as the serrations are arranged at positions opposed to each other in the crimped state. Due to this arrangement, a crimp force is lowered at the positions of the long grooves 118. As a result, a newly-formed surface resulting from an elongation of the strands 101*a* is hardly generated to cause no agglutination. Thus, if no agglutination is generated among the strands 101*a* in this way, then the conduction characteristics among the strands 101*a* cannot be improved, to cause the electrical resistance at electrical connection points to be elevated.

Therefore, an object of the present application is to provide a crimp terminal capable of reducing its electrical resistance at electrical connection points with an electrical wire.

A crimp terminal according to an aspect of the present application includes a core-wire crimping part configured to be crimped to a core wire composed of a plurality of strands, the core-wire crimping part being provided, on its surface for arranging the core wire thereon, with serrations which extend in a direction perpendicular to the axial direction of the core wire. The serrations include a central serration part and an end serration part which are arranged on respective surfaces of the core-wire crimping part that face each other when the core-wire crimping part is crimped to the core wire, the central serration part and the end serration part being arranged at respective positions deviated from each other in the axial direction of the core wire, and each having a protruding cross-sectional shape.

Each of the central serration part and the end serration part may have the protruding cross-sectional shape provided, at its tip, with an edge.

With the crimp terminal according to the aspect of the present application, due to compression force by the crimping process, the central serration part and the end serration part dig into the core wire alternately in the axial direction of the core wire. Thus, the core wire is deformed by the digging operation greatly, so that a newly-formed surface is generated in each strand by its elongation. Additionally, as the central serration parts and the end serration part have protruding cross-sectional shapes and are positioned on surfaces facing each other, the compression force is increased, so that a great crimping force acts on the core wire. That is, due to the generation of a newly-formed surface by the elongation of each strand and the increasing of compression force to be applied on each strand, agglutination is produced to improve the conduction characteristics among the strands, From above, the electrical resistance of electrical connection points is reduced.

DESCRIPTION OF EMBODIMENTS

A crimp terminal according to an embodiment will be described with reference to FIGS. 1 to 5.

Figure 1:
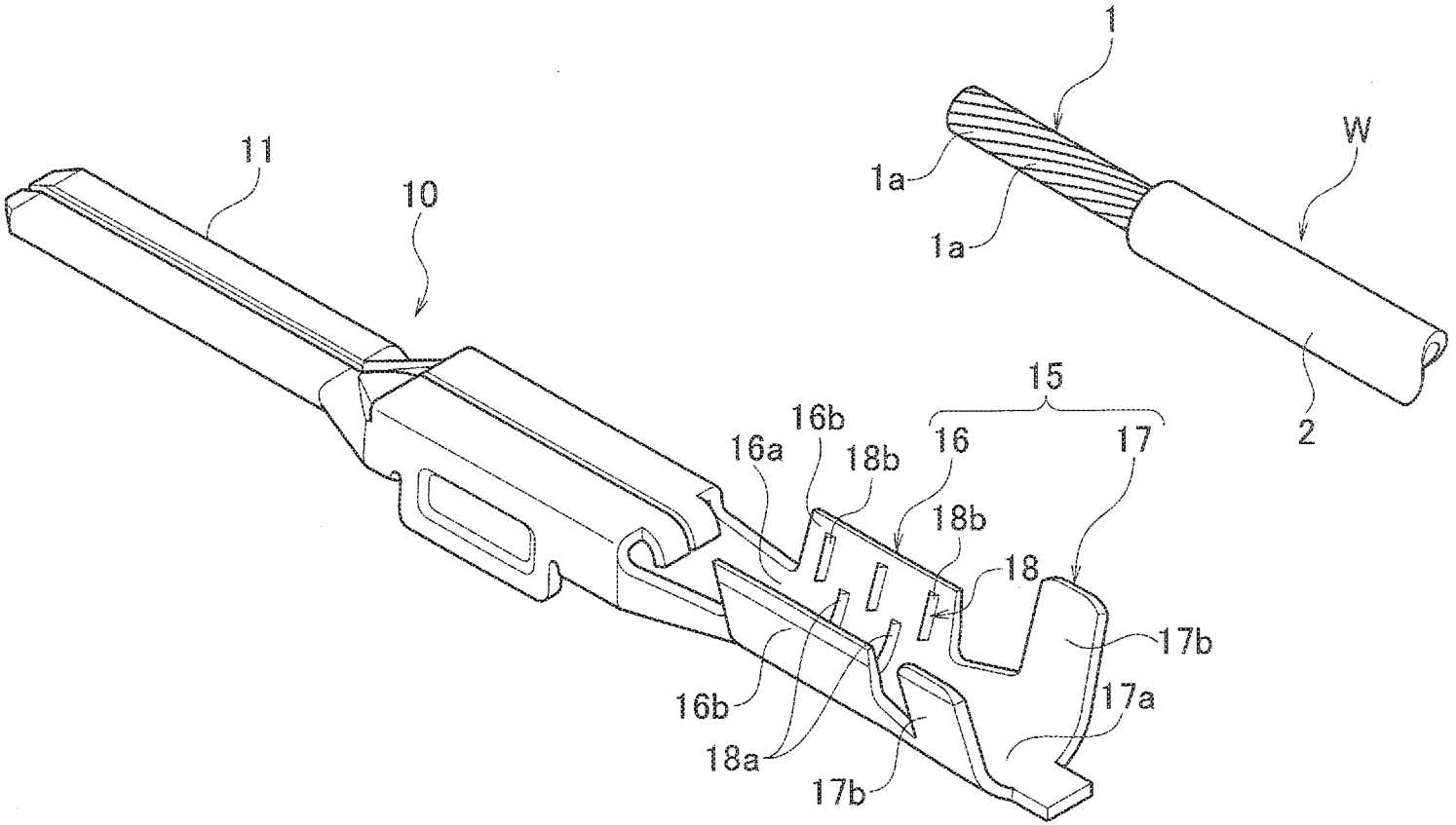
FIG. 1 is a perspective view of a crimp terminal according to an embodiment, illustrating a state before crimping an electric wire to the crimp terminal.
Figure 2A:
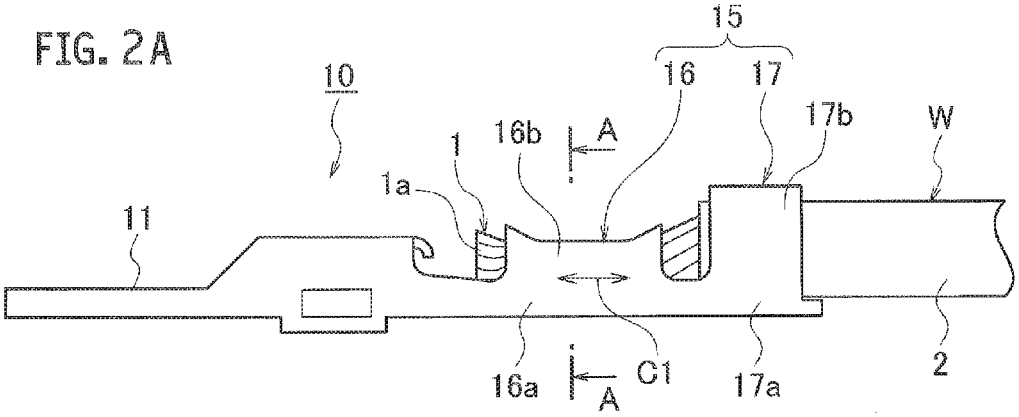
FIG. 2A is a side view of a state where the electric wire is crimped to the crimp terminal according to the embodiment.
Figure 2B:
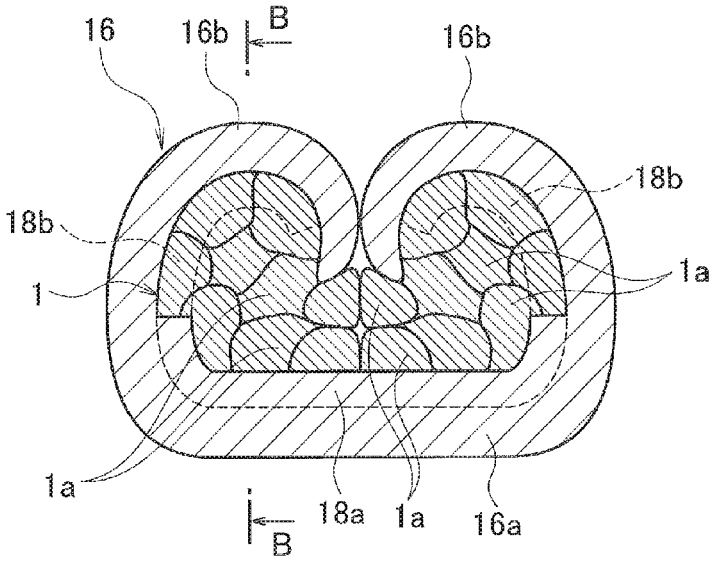
FIG. 2B is a sectional view taken along a line A-A of FIG. 2A.

As illustrated in FIGS. 1 and 2, an electric wire W includes a core wire 1 composed of a plurality of strands 1*a*, and an insulating jacket 2 covering the outer periphery of the core wire 1. On a leading-end side of the electric wire 1, the insulating jacket 2 is removed to expose the core wire 1. The core wire 1 includes a number of strands 1*a* made of aluminum or aluminum alloy (referred to as "aluminum-made" below) and also twisted each other. That is, the electric wire W is an aluminum cable.

A crimp terminal 10 is made of copper alloy and formed by folding a plate cut into a predetermined shape. The crimp terminal 10 includes a partner-terminal connecting part 11 and a wire-connecting part 15. The wire-connecting part 15 includes a core-wire crimping part 16 and a jacket crimping part 17. The core-wire crimping part 16 includes a first bottom part 16*a* and a pair of first crimping-piece parts 16*b* extending from both sides of the first bottom part 16*a*.

Figure 3A:
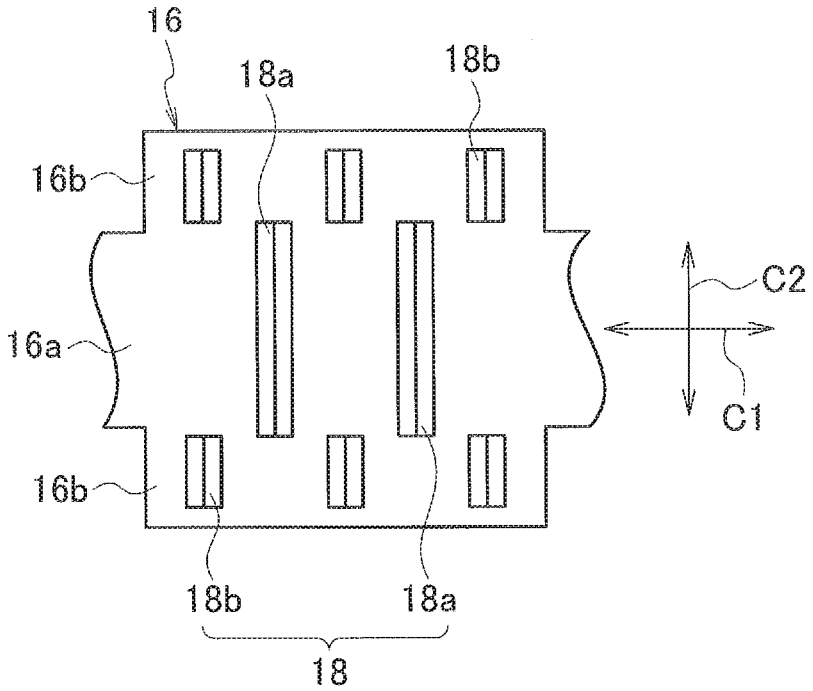
FIG. 3A is a development view at a serration section of the core-wire crimping part of the crimp terminal according to the embodiment.
Figure 3B:
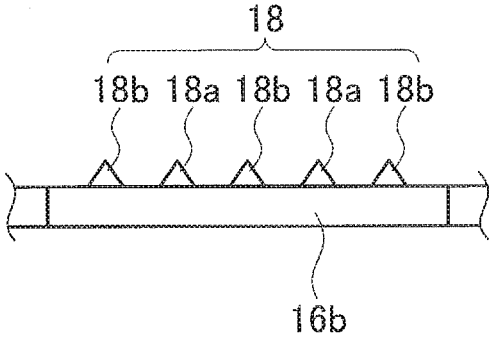
FIG. 3B is a side view of FIG. 3A.

In the core-wire crimping part 16, the first bottom part 16*a* and the pair of first crimping-piece parts 16*b* are provided, on their respective surfaces (i.e. surfaces to which the core wire 1 is to be crimped), with a plurality of serrations 18. As illustrated in FIGS. 3A and 3B in detail, the respective serrations 18 are extended along an orthogonal direction C2 to the axial direction of the core-wire crimping part 16. The serrations 18 includes central serration parts 18*a* and respective pairs of left and right end serrations parts 18*b*, which are arranged on respective surfaces that face each other when the core-wire crimping part 16 is crimped to the core wire 1. Specifically, the central serration parts 18*a* are provided in the first bottom part 16*a*, while the pairs of left and right end serration parts 18*b* are provided in the pair of first crimping-piece parts 16*b*. The central serration parts 18*a* and the pairs of left and right end serration parts 18 are arranged in respective positions deviated from each other in the axial direction of the core wire 1. The central serration parts 18*a* and the end serration parts 18*b* have respective protruding cross-sectional shapes so as to be triangular when viewed from a side and also have edges (each corresponding to an apex of triangle) at respective tips of the protruding cross-sectional shapes.

The jacket crimping part 17 includes a second bottom part 17*a* and a pair of second crimping-piece parts 17*b*.

In the crimp terminal 10, the core-wire crimping part 16 crimps the exposed core wire 1 so as to surround it from the outside, while the jacket crimping part 17 crimps the insulating jacket 2.

Figure 4:
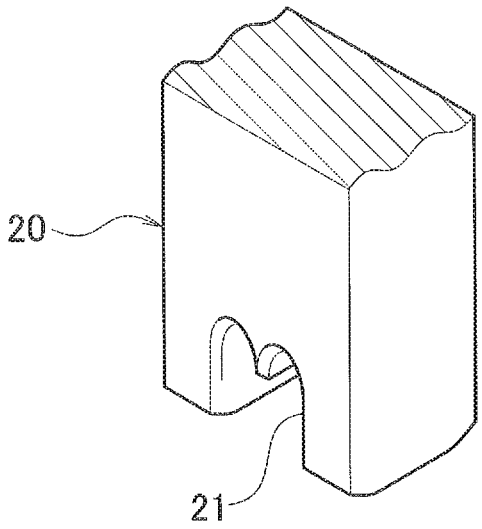
FIG. 4 is a perspective view of a crimping jig used in crimping the crimp terminal according to the embodiment.
Figure 5:
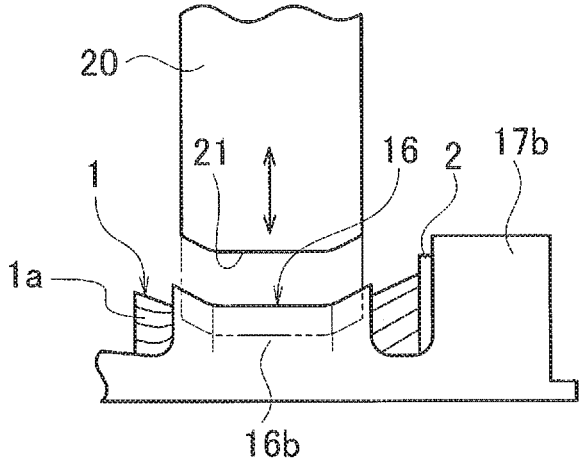
FIG. 5 is a side view explaining the crimping operation of the crimp terminal according to the embodiment by use of the crimping jig.
Figure 6:
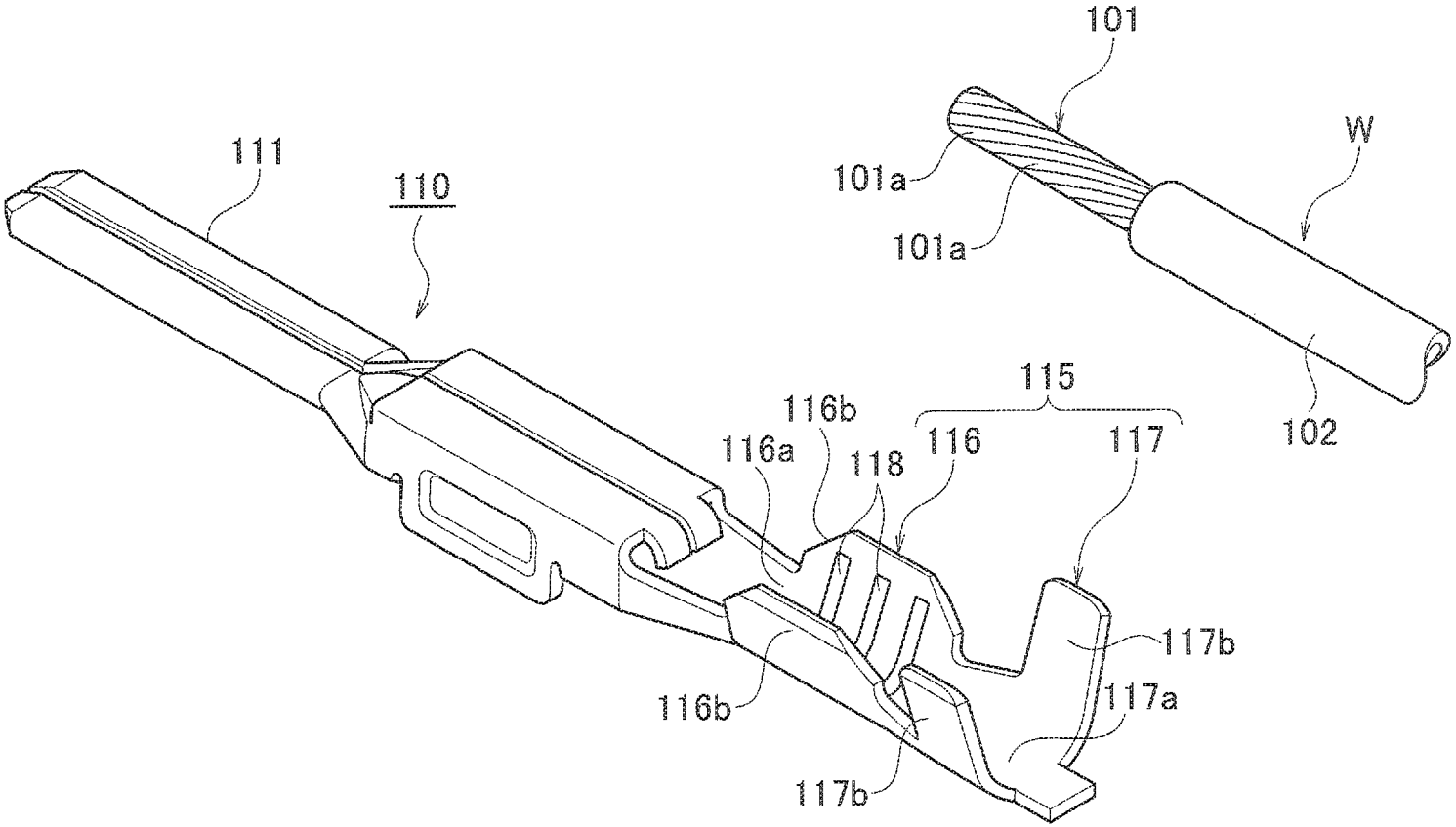
FIG. 6 PRIOR ART
FIG. 6 is a perspective view of a state before crimping the electric wire to the crimp terminal of the conventional example.
Figure 7:
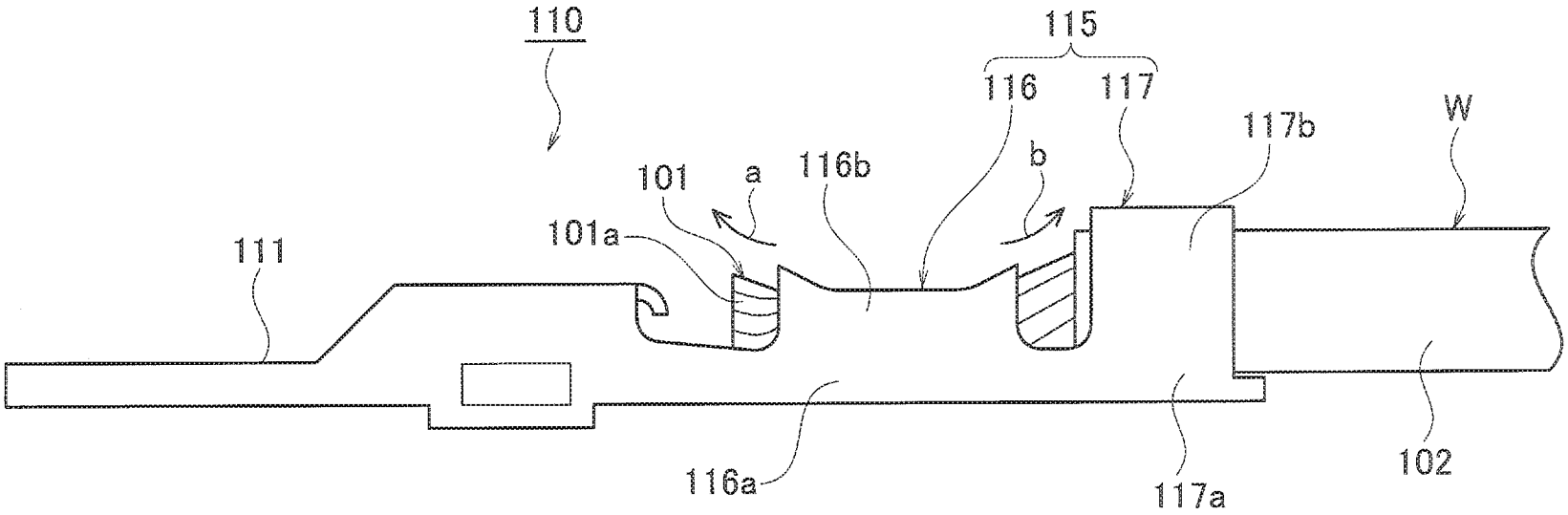
FIG. 7 PRIOR ART
FIG. 7 is a perspective view of a state after crimping the electric wire to the crimp terminal of the conventional example.
Figure 8:
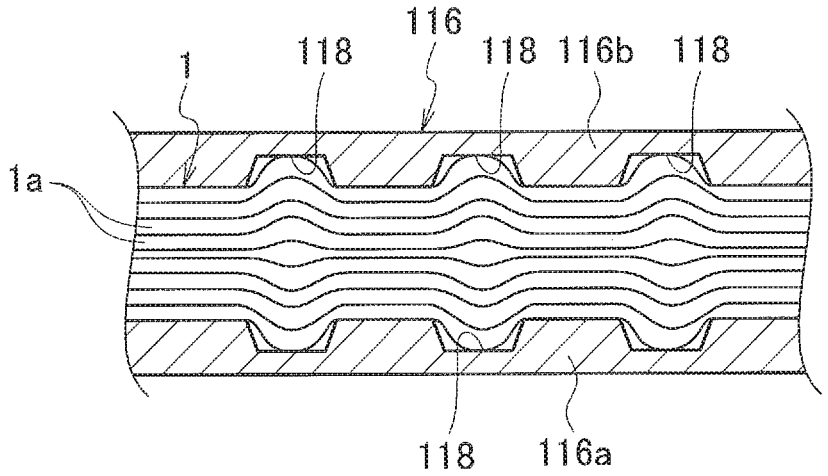
FIG. 8 PRIOR ART
FIG. 8 is a sectional view of the core-wire crimping part of the crimp terminal of the conventional example.

The crimp terminal 10 is crimped by a crimping jig 20 as illustrated in FIG. 4. The crimping jig 20 is formed, on its crimping-tip side, with a crimping groove 21 having a final crimping outer profile. As illustrated in FIG. 5, when the crimping jig 20 thrusts the pair of first crimping-piece parts 16*b* at their upper side, the pair of first crimping-piece parts 16*b* are deformed along the crimping groove 21 plastically.

Figure 2C:
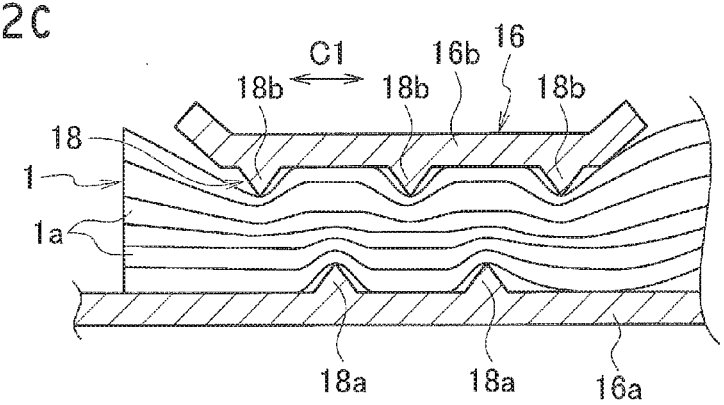
FIG. 2C is a sectional view taken along a line B-B of FIG. 2B.

In this crimping process, the core wire 1 is subjected to compression force through the core-wire crimping part 16. By this compression force, as illustrated in FIG. 2C, the central serration parts 18*a* and the end serration parts 18*b* dig into the core wire 1 alternately in the axial direction C1 of the core wire 1. In this way, since the central serration parts 18*a* and the end serration parts 18*b* dig into the core wire 1, the core wire 1 is deformed greatly, so that a newly-formed surface is generated in each of the strands 1*a* by its elongation. Additionally, as the central serration parts 18*a* and the end serration parts 18*b* are provided with respective protruding cross-sectional shapes and also positioned on respective surfaces that face each other (i.e. surfaces above and below the core wire 1), the compression force on the core wire 1 is increased. Therefore, a crimping force is applied on the core wire 1. That is, due to the generation of a newly-formed surface by the elongation of each of the strands 1*a* and the increasing of compression force on each of the strands 1*a*, agglutination is produced to improve the conduction characteristics among the strands 1*a*. From above, the electrical resistance of electrical connection points is reduced.

Each of the strands 1*a* making contact with or coming close to the inner surface of the core-wire crimping part 16 digs into the central serration parts 18*a* and the end serration parts 18*b*. Accordingly, the resulting agglutination between the core wire 1 and the core-wire crimping part 16 is generated and also promoted. Thus, this leads to a reduction in conduction resistance between the core wire 1 and the core-wire crimping part 16 (the crimp terminal 10). The electrical resistance at the electrical connection points is also thereby reduced. Furthermore, each of the strands 1*a* digs into the central serration parts 18*a* and the end serration parts 18*b*. Thus, the tension strength (mechanical strength) between the core wire 1 and the core-wire crimping part 16 is also improved.

By changing design of a part of the crimp terminal 10 in this way, it is possible to improve the conduction characteristics of the core wire 1 at the electrical connection points. Thus, it is possible to reduce the electric resistance of the electrical connection points without almost increasing the cost, in comparison with the formation of a core wire in a single line or the like.

As the central serration parts 18*a* and the end serration parts 18*b* have substantially triangular cross-sections and edges at respective tips, these parts dig into the strands 1*a* securely. Consequently, the generation of agglutination is improved.

The core wire 1 is made of aluminum. In case of an aluminum strand 1*a*, its surface is covered with an oxide layer whose thickness is larger than that of an oxide layer formed on a strand made of copper alloy. For this reason, the aluminum core wire 1 has faced the problem that the electric resistance is increased due to the conduction resistance among the strands 1*a*. To the contrary, as the conduction resistance among the strands 1*a* can be reduced in the crimp terminal 10 according to the embodiment, the present application would be effective for an aluminum electric wire, especially, Comparing with a core wire made of copper alloy, the aluminum core wire 1 is relatively soft and stretchy. Due to the above reason, it is possible to allow the compression force resulting from crimping of the core-wire crimping part 16 to act on the core wire 1 effectively. Thus, the crimp terminal 10 according to the embodiment is advantageous to, especially, an aluminum electric, wire from this point of view.

(Modification)

Although the central serration parts 18*a* and the end serration parts 18*h* have triangular-protruding cross-sectional shapes in the crimp terminal 10 according to the embodiment, the cross section of each serration part may be in the form of any shape as long as it has a protruding cross-sectional shape, preferably in the form of a serration whose tip is formed with an edge.

Although the crimp terminal 10 according to the embodiment has been illustrated with an example of the core wire 1 made of aluminum, the present application is also applicable to a core wire 1 other than the aluminum core wire (e.g. core wire made of copper alloy).

What is claimed is:

1. A crimp terminal, comprising a core-wire crimping part configured to be crimped to a core wire including a plurality of strands, the core-wire crimping part being provided, on a surface thereof for arranging the core wire thereon, with elongated serrations that extend in a direction perpendicular to an axial direction of the core wire, wherein the core-wire crimping part comprises a first bottom part and a pair of first crimping-piece parts extending from both sides of the first bottom part, a surface of the first bottom part and respective surfaces of the pair of first crimping-piece parts facing each other when the core-wire crimping part is crimped to the core wire, the serrations comprise a central serration part provided on the surface of the first bottom part and a pair of end serration parts provided on the respective surfaces of the pair of first crimping-piece parts, the central serration part being discontinuous with the pair of end serration parts, the central serration part and the pair of end serration parts each extending in the direction perpendicular to the axial direction of the core wire, the central serration part and the pair of end serration parts are arranged at respective positions deviated from each other in the axial direction of the core wire, each of the central serration part and the pair of end serration parts has a protruding cross-sectional shape, and the protruding cross-sectional shape has an edge that extends in the direction perpendicular to the axial direction of the core wire, the edge having a tip configured to dig into ones of the plurality of strands of the core wire when the core-wire crimping part is crimped to the core wire so as to increase an agglutination between the core-wire crimping part and the core wire.

2. The crimp terminal of claim 1, wherein each of the central serration part and the pair of end serration parts has the protruding cross-sectional shape provided with a triangular shape such that the edge with the tip corresponds to an apex of the triangular shape.

3. The crimp terminal of claim 1, wherein the plurality of strands are made of aluminum or aluminum alloy.

4. The crimp terminal of claim 1, wherein the plurality of strands are twisted with each other.

5. The crimp terminal of claim 1, wherein the crimp terminal is made of copper alloy and formed by folding a plate cut into a predetermined shape.

6. The crimp terminal of claim 3, wherein the serrations are configured to penetrate an oxide layer having a thickness larger than that of an oxide layer formed on each of the strands made of aluminum or aluminum alloy when the core-wire crimping part is crimped to the core wire so to as to reduce an electric resistance due to the conduction resistance among the plurality of strands.

7. The crimp terminal of claim 1, wherein the plurality of strands are made of copper alloy.

* * * * *